US010794091B2

(12) United States Patent
Smith et al.

(10) Patent No.: US 10,794,091 B2
(45) Date of Patent: Oct. 6, 2020

(54) GATE LATCH ASSEMBLY

(71) Applicant: D & D Group Pty Ltd, Frenches Forest, New South Wales (AU)

(72) Inventors: Glenn Smith, Upper Duroby (AU); James Novak, Bald Hills (AU)

(73) Assignee: D & D Group Pty Ltd, Frenchs Forest, New South Wales (AU)

( * ) Notice: Subject to any disclaimer, the term of this patent is extended or adjusted under 35 U.S.C. 154(b) by 1164 days.

(21) Appl. No.: 14/768,460

(22) PCT Filed: Jan. 24, 2014

(86) PCT No.: PCT/AU2014/000048

§ 371 (c)(1),
(2) Date: Aug. 18, 2015

(87) PCT Pub. No.: WO2014/127399

PCT Pub. Date: Aug. 28, 2014

(65) Prior Publication Data

US 2016/0002955 A1 Jan. 7, 2016

Related U.S. Application Data

(60) Provisional application No. 61/767,153, filed on Feb. 20, 2013.

(30) Foreign Application Priority Data

Feb. 20, 2013 (AU) ..... 2013900571

(51) Int. Cl.
*E05B 65/00* (2006.01)
*E05C 19/16* (2006.01)
(Continued)

(52) U.S. Cl.
CPC ..... *E05B 65/0007* (2013.01); *E04H 4/06* (2013.01); *E05B 1/0053* (2013.01); *E05B 27/00* (2013.01);
(Continued)

(58) Field of Classification Search
CPC .. Y10T 292/11; E05B 65/0007; E05B 1/0053; E05B 45/06; E05B 2045/065;
(Continued)

(56) References Cited

U.S. PATENT DOCUMENTS 997,036 A * 7/1911 Blackburn ..... H01H 13/02 200/530
4,465,997 A * 8/1984 Hines ..... E05B 45/086 200/61.68
(Continued)

FOREIGN PATENT DOCUMENTS

AU 2007100682 A4 8/2007
CN 1274402 11/2000
(Continued)

OTHER PUBLICATIONS

International Preliminary Report on Patentability for Application No. PCT/AU2014/000048 dated Jun. 18, 2015 (61 pages).
(Continued)

*Primary Examiner* — Kristina R Fulton
*Assistant Examiner* — Faria F Ahmad
(74) *Attorney, Agent, or Firm* — Michael Best & Friedrich LLP

(57) ABSTRACT

A gate latch arranged to be mounted to either a gate or gate post and adapted to co-operate with a component mounted on the other of the gate or gate post to hold the gate closed, the gate latch comprising: a latch mechanism, and a housing containing at least a portion of the latch mechanism, the
(Continued)

housing being configured to receive at least one latch accessory to modify the gate latch.

16 Claims, 13 Drawing Sheets

(51) Int. Cl.

| | |
|---|---|
| ***E04H 4/06*** | (2006.01) |
| ***E05B 1/00*** | (2006.01) |
| ***E05B 45/12*** | (2006.01) |
| ***E05B 27/00*** | (2006.01) |
| ***E05B 45/06*** | (2006.01) |
| ***E05B 47/00*** | (2006.01) |
| ***E05C 9/00*** | (2006.01) |
| ***E05C 19/00*** | (2006.01) |
| ***E05C 19/18*** | (2006.01) |
| ***E05C 21/00*** | (2006.01) |
| ***E06B 9/00*** | (2006.01) |
| ***E06B 11/02*** | (2006.01) |
| ***E05B 17/20*** | (2006.01) |

(52) U.S. Cl.
CPC ..... *E05B 45/06* (2013.01); *E05B 45/12* (2013.01); *E05B 47/004* (2013.01); *E05B 65/0014* (2013.01); *E05C 9/006* (2013.01); *E05C 19/003* (2013.01); *E05C 19/163* (2013.01); *E05C 19/188* (2013.01); *E05C 21/00* (2013.01); *E05B 2017/2096* (2013.01); *E05B 2045/0665* (2013.01); *E06B 11/02* (2013.01); *E06B 2009/002* (2013.01); *Y10T 292/11* (2015.04)

(58) Field of Classification Search
CPC .. E05B 45/12; E05B 65/0014; E05B 47/0038; E05B 47/004; E05C 9/006; E05C 19/003; E05C 19/163; E05C 19/188; E05C 19/18; E05C 19/182; E05C 19/184; E05C 21/00; E05C 2045/0665; E05V 47/0044; E06B 2009/002; E06B 11/02; E06B 2017/2096
See application file for complete search history.

(56) References Cited

U.S. PATENT DOCUMENTS 5,217,265 A 6/1993 Lerner
5,243,325 A * 9/1993 Marin ..... E05B 45/083 200/61.93
5,358,292 A * 10/1994 Van Wiebe ..... E05B 53/003 292/125
5,362,116 A * 11/1994 Doyle ..... E05C 19/163 292/144
5,408,219 A * 4/1995 Newman ..... G08B 13/122 340/541
5,786,761 A 7/1998 Hui
5,867,107 A * 2/1999 Gartner ..... E05B 47/00 235/382
6,114,963 A * 9/2000 Blake ..... G08B 21/0202 340/521
6,176,042 B1 * 1/2001 Rossman ..... A01K 1/0017 160/210
6,347,486 B1 * 2/2002 Badillet ..... E05B 47/00 49/394
6,691,467 B2 * 2/2004 Hincher, Sr. ..... E06B 9/04 362/152
7,318,298 B2 * 1/2008 Marsden ..... E06B 9/04 362/152
7,334,624 B2 * 2/2008 Waldman ..... E05B 17/2053 160/144
7,385,521 B2 * 6/2008 Macari ..... G08B 13/1409 340/546
7,627,985 B2 * 12/2009 Marsden ..... E05B 65/0014 49/394
7,847,689 B1 * 12/2010 Woitalla ..... G08B 13/08 200/61.93
8,686,869 B2 * 4/2014 Sharma ..... G01B 7/31 292/251.5
8,733,017 B2 * 5/2014 Marsden ..... E05B 41/00 49/333
8,820,803 B2 * 9/2014 Hunt ..... E05B 65/108 292/251.5
8,943,187 B1 * 1/2015 Saylor ..... G06F 21/6209 709/223
9,353,550 B1 * 5/2016 Smith, III ..... E05B 41/00
9,394,723 B1 * 7/2016 Roth ..... E05B 27/006
9,464,467 B1 * 10/2016 Flannery ..... E05B 65/0007
9,523,218 B1 * 12/2016 McGraw ..... E05B 45/005
9,834,975 B2 * 12/2017 Pignolet ..... G08B 21/18
10,027,503 B2 * 7/2018 Patrick ..... G07C 9/00571
10,053,889 B1 * 8/2018 Maratos ..... E05B 45/005
10,091,970 B1 * 10/2018 Flannery ..... A01K 1/034
10,109,140 B1 * 10/2018 Spencer ..... G07D 11/009
2002/0163202 A1 * 11/2002 Hansen ..... B60J 7/185 292/95
2002/0194786 A1 * 12/2002 Hincher, Sr. ..... E06B 9/04 49/463
2003/0197164 A1 * 10/2003 Monahan ..... E06B 9/08 256/24
2007/0024442 A1 * 2/2007 Jolley ..... E05B 17/10 340/542
2010/0031714 A1 2/2010 Brown et al.
2010/0033279 A1 2/2010 Clark
2011/0101706 A1 5/2011 Wells
2011/0148126 A1 * 6/2011 Macernis ..... E05B 65/0007 292/251.5
2011/0193354 A1 8/2011 Simmonds
2011/0291848 A1 * 12/2011 Burdenko ..... E05B 15/0245 340/665
2012/0299314 A1 * 11/2012 Jiang ..... E05B 45/083 292/137
2013/0049382 A1 * 2/2013 Day ..... E05C 19/16 292/251.5
2013/0199094 A1 * 8/2013 Lachance ..... G08B 13/08 49/13
2013/0257063 A1 * 10/2013 Ishitsuka ..... B60R 25/02153 292/144
2014/0159383 A1 * 6/2014 Sharma ..... G01B 7/31 292/137
2014/0292001 A1 * 10/2014 Nunez ..... E05C 1/004 292/164
2017/0350165 A1 * 12/2017 Schort ..... E05B 47/0603
2018/0313111 A1 * 11/2018 Park ..... E05B 15/0073
2018/0340350 A1 * 11/2018 Johnson ..... G08B 3/10
2018/0371796 A1 * 12/2018 Talpe ..... E05B 47/0002

FOREIGN PATENT DOCUMENTS

| | | | |
|---|---|---|---|
| CN | 2570399 | Y | 9/2003 |
| CN | 201193417 | Y | 2/2009 |
| CN | 102160090 | B | 8/2011 |
| DE | 10313711 | | 10/2004 |
| EP | 0484594 | | 5/1992 |
| WO | 2006/037174 | | 4/2006 |
| WO | 2011/088496 | | 7/2011 |
| WO | WO-2014127413 | A1 | 8/2014 |

OTHER PUBLICATIONS

International Search Report for Application No. PCT/AU2014/000048 dated Mar. 18, 2014 (3 pages).
European Search Report for Application No. 14754183.3 dated Dec. 23, 2016 (8 pages).

(56) References Cited

OTHER PUBLICATIONS

English Translation of Chinese Patent Office Action for Application No. 201480009326.9 dated Nov. 28, 2016 (17 pages).

* cited by examiner

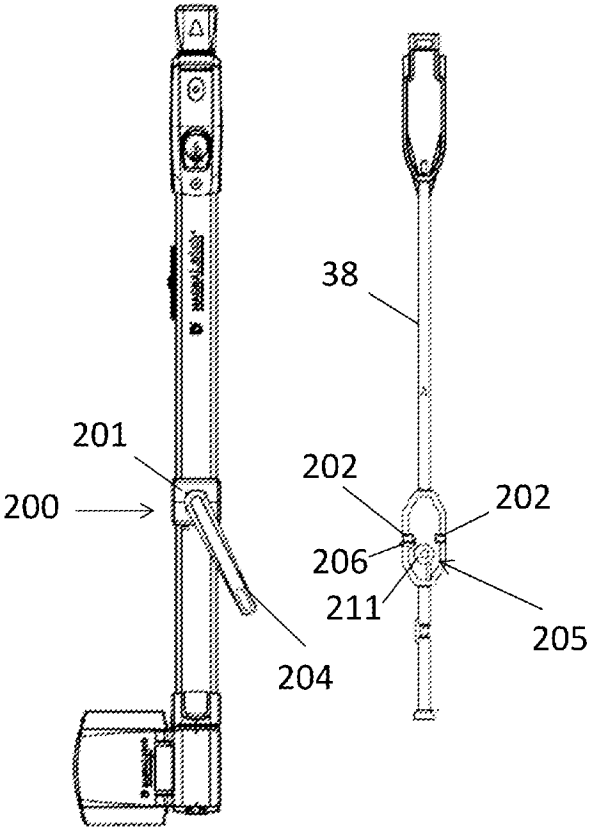
Fig. 14b
Fig. 13b
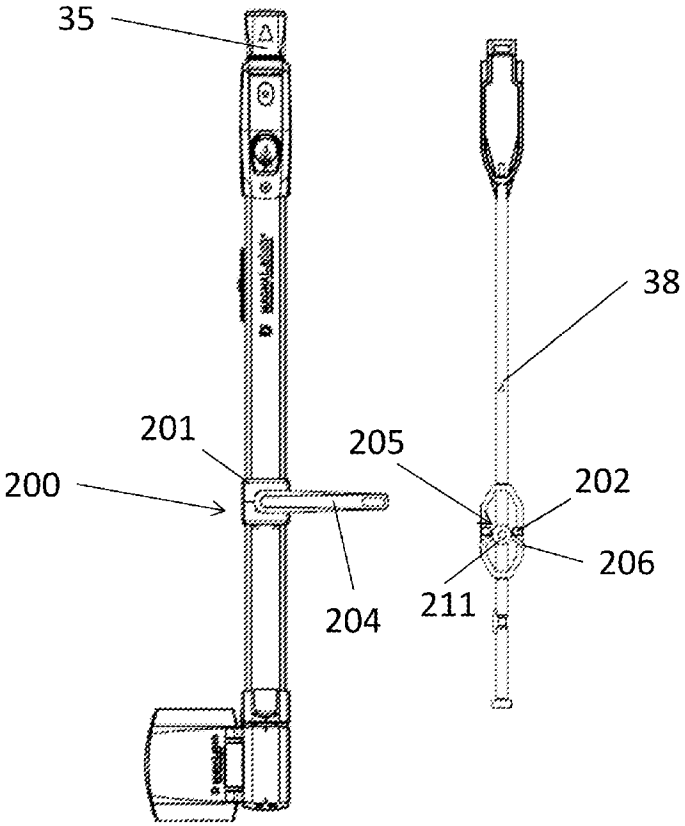
Fig. 14a
Fig. 13a

GATE LATCH ASSEMBLY

TECHNICAL FIELD

The present disclosure relates to latches and latch assemblies associated with gates and components for use in such latch assemblies. The disclosure has particular application to but not limited to, gate latches for pool fencing and other safety enclosures.

Background to the Disclosure

To prevent young children from entering areas such as a swimming pool without supervision, safety enclosures are provided. In some cases such as for swimming pools, fences are usually required by law. These safety enclosures generally include a self-latching assembly which is arranged to operate automatically on closing of the gate of the enclosure and prevents the gate from being reopened without manual release of the mechanism.

One form of such a self-latching assembly includes a magnet to moves components of the assembly into a latched configuration, an example of which is described in WO92/03631. It is considered desirable to improve the functionality of latch assemblies and/or to reduce the costs associated with these products.

SUMMARY OF THE DISCLOSURE

According to one embodiment, the present disclosure provides a gate latch arranged to be mounted to either a gate or gate post and adapted to co-operate with a component mounted on the other of the gate or gate post to hold the gate closed, the gate latch comprising:

a latch mechanism, and a housing containing at least a portion of the latch mechanism, the housing being configured to receive at least one latch accessory to modify the gate latch.

According to another embodiment, the present disclosure provides, a gate latch assembly comprising the gate latch as described in the above embodiment and at least one latch accessory receivable on the gate latch.

According to another embodiment, the present disclosure provides, a gate latch assembly comprising the latch as described in the above embodiment a plurality of different latch accessories configured to modify the gate latch by receiving a selected one or more of the latch accessories on the housing.

According to another embodiment, the present disclosure provides, a method of assembling a gate latch assembly, the method comprising providing a gate latch comprising a latch mechanism and a housing configured to receive a latch accessory; and mounting a latch accessory to the housing.

According to another embodiment, the present disclosure provides, a method of assembling a gate latch assembly, the method comprising:

(a) providing a gate latch comprising a latch mechanism;

(b) mounting at least one latch accessory to the gate latch to form the gate latch assembly, whereby when mounted the latch accessory interacts with the latch mechanism.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF FIGURES

Embodiments of the disclosure will now be described by way of example only, with reference to the accompanying drawings in which:

FIGS. 13*a-b* are front views of the gate latch assembly of FIG. 1 with an alternative actuator module fitted to the housing having an alternative actuator in a latched condition (FIG. 13*a*) and in an unlatched condition position (FIG. 13*b*);

FIGS. 14*a-b* are front views of parts of the alternative access actuator module and the latching mechanism interacting in the latched condition (FIG. 14*a*) and in the unlatched condition (FIG. 14*b*)

DETAILED DESCRIPTION OF EMBODIMENTS

Figure 1:
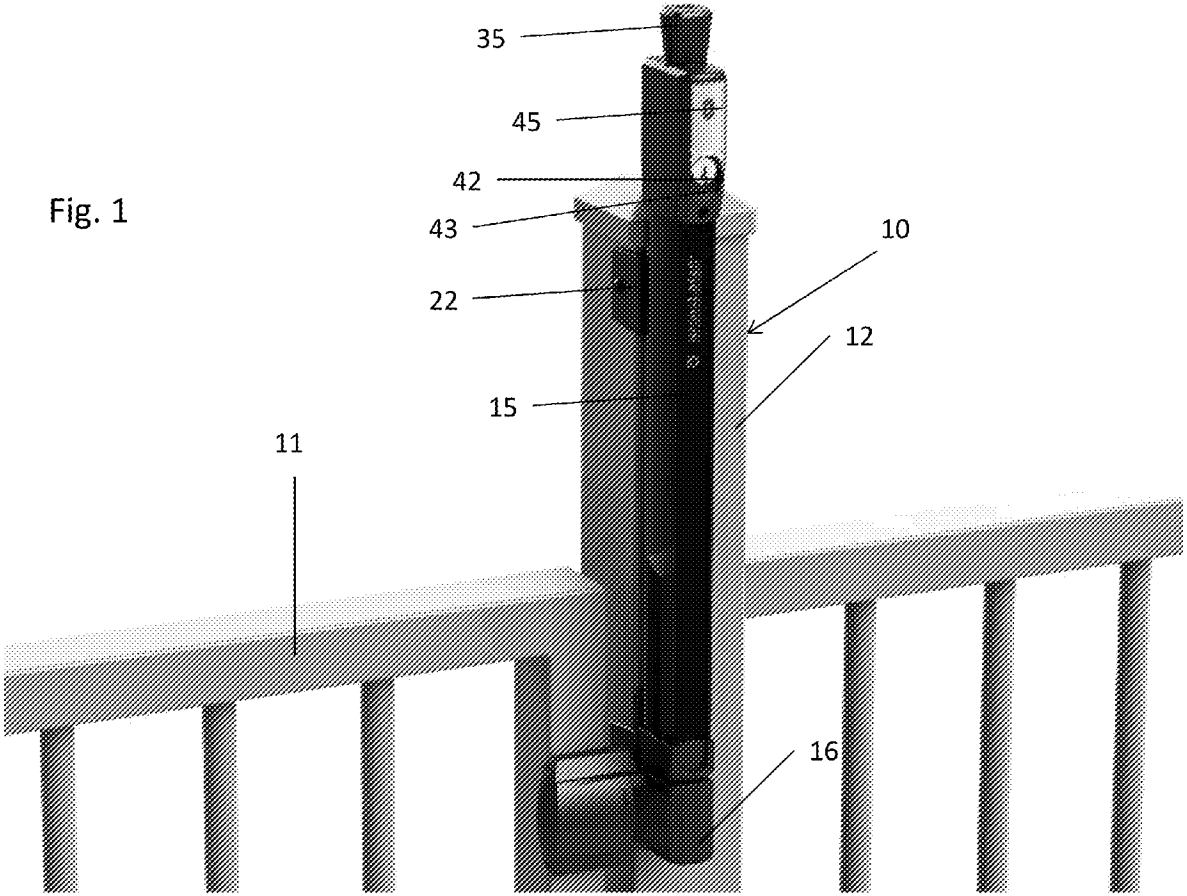
FIG. 1 is a perspective view of a gate latch assembly according to an embodiment of the present disclosure in use on a gate, with the gate in a closed position.

In the following detailed description, reference is made to the accompanying drawings, which form a part thereof. In the drawings, similar symbols typically identify similar components, unless context dictates otherwise. The illustrative embodiments described in the detailed description, drawings, clauses and claims are not meant to be limiting. Other embodiments may be utilised, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

The present disclosure relates generally to gate latch assemblies. In the illustrated embodiment, the gate latch assembly is used to latch a gate such as that found in pool fencing or other safety enclosures.

A previous gate latch assembly is disclosed in PCT International Publication WO 92/03631 (WO '631). The assembly of WO '631 is particularly suitable for pool fencing and other safety enclosures and utilises magnetic force to affect operation of the latch. The latch assembly in WO '631 comprises a latch comprising a latching pin mounted within a latch housing and movable between a retracted (unlatched) and an extended (latched) position. The latch pin is biased into the retracted position. Normally the latch is attached to a gate post and is orientated so that the latch pin moves within the latch housing in a vertical direction. The latch operates in conjunction with a striker that forms part of the latch assembly and which is typically mounted on the gate. The striker comprises a recess which is arranged to receive the latch pin. A permanent magnet is also provided in the striker to draw the latching pin into the recess of the striker when the striker is moved into register with the latch (when the gate is moved to the closed position) so as to effect latching of the assembly to hold the gate closed.

It is to be appreciated that whilst embodiments of the present disclosure described herein involve modifications, additions and improvements in relation to the above described magnetic latching assembly, the embodiments could be applied to other magnetic and non-magnetic latching assemblies.

Disclosed in some embodiments is a gate latch arranged to be mounted to either a gate or gate post and adapted to co-operate with a component mounted on the other of the gate or gate post to hold the gate closed, the gate latch comprising:

a latch mechanism, and a housing containing at least a portion of the latch mechanism, the housing being configured to receive at least one latch accessory to modify the gate latch.

In some embodiments, the housing comprises at least one coupling portion configured to receive the at least one latch accessory having a complementary coupling portion so as to mount the at least one latch accessory to the housing.

In some embodiments, the at least one coupling portion of the housing is configured to enable engagement of the at least one latch accessory coupling portion with the housing coupling portion in a snap fit arrangement.

In some embodiments, the at least one coupling portion of the housing is configured to enable engagement of the least one latch accessory coupling portion with the housing coupling portion in a sliding arrangement.

In some embodiments, the at least one coupling portion of the housing is integrally formed with the housing.

In some embodiments, the at least one coupling component of the housing comprises one or more rails provided on the housing.

In some embodiments, each rail extends the substantial length of the housing.

In some embodiments, each rail comprises a plurality of rail segments.

In some embodiments, the housing comprises a body extending between a first end and a second end along a longitudinal axis and at least one of the coupling portions of the housing extends longitudinally along the body.

In some embodiments, the housing body is in the form of an extruded section.

In some embodiments, the housing comprises at least one housing end structure mounted to one or each end of the body.

In some embodiments, one or each of the housing end structures has formed thereon at least one of the coupling portions of the housing.

In some embodiments, the latch mechanism has an internally mounted latch member, the latch member being moveable between an engaging position and a retracted position, wherein when the latch member is in the retracted position it retracts into the housing.

In some embodiments, the latch further comprises an actuator for moving the latch member from the retracted to the engaging position within the housing.

In at least one embodiment a gate latch assembly is disclosed. The gate latch assembly may comprise the gate latch as described in any one of the above embodiments and at least one latch accessory receivable on the gate latch.

In some embodiments, the at least one latch accessory modifies the gate latch by interacting with the latch mechanism to affect a functional aspect of the gate latch.

In some embodiments, the or one of the latch accessories comprises a decorative latch accessory that is configured to modify the appearance of the gate latch when received thereon.

In some embodiments, the or one of the latch accessories comprises an electronic sensor that is configured to alert a user when the latch mechanism is in an unlatched condition when the electronic sensor is received on the gate latch.

In some embodiments, the latch mechanism comprises a primary actuator which is operative to unlatch the latch mechanism from a latched condition, and the or one of the latch accessories comprises an alternative actuator module that provides a second actuator at a different location to the primary actuator which is also operative to unlatch the latch mechanism from its latched condition.

In some embodiments, the alternative actuator module comprises a base component that is configured to interact with the latching mechanism and wherein the second actuator is coupled to the base component.

In some embodiments, the actuator is detachable from the base component to render the alternative actuator module inoperative.

In some embodiments, the second actuator and the base component comprise corresponding key formations to enable coupling of the actuator to the base component.

In some embodiments, the base component comprises an actable member that is located within the housing of the gate latch in engagement with the latch mechanism.

In some embodiments, the second actuator is located below the primary actuator.

In some embodiments, the latch assembly further comprising a striker that cooperates with the latch mechanism of the gate latch to effect latching.

In some embodiments, the striker includes a retaining element that is configured to receive a portion of the latch mechanism in the engaging position.

Disclosed in some embodiments is a gate latch assembly comprising the gate latch as described in any one of the above embodiments and a plurality of different latch accessories configured to modify the gate latch by receiving a selected one or more of the latch accessories on the housing.

Disclosed in some embodiments is a method of assembling a gate latch comprising providing a gate latch comprising a latch mechanism and a housing configured to receive a latch accessory; and mounting a latch accessory to the housing.

Disclosed in some embodiments is a method of assembling a gate latch assembly comprising:

(a) providing a gate latch comprising a latch mechanism;

(b) mounting at least one latch accessory to the gate latch to form the gate latch assembly, whereby when mounted the latch accessory interacts with the latch mechanism.

Figure 3:
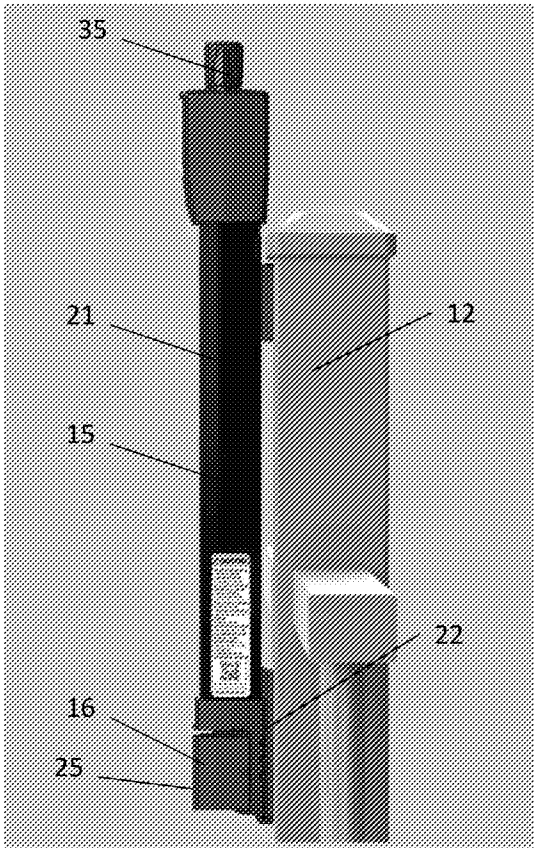
FIG. 3 is a side view of the gate latch assembly of FIG. 1.
Figure 2:
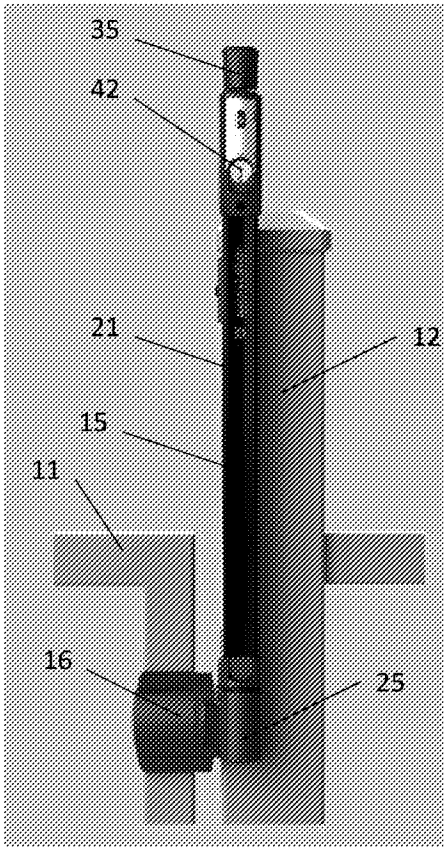
FIG. 2 is a front view of the gate latch assembly of FIG. 1.

Referring to FIG. 1, an illustrative embodiment of a gate latch assembly 10 is shown and will now be described. Referring to FIGS. 1 to 3, the gate latch assembly 10 is shown installed for use on a safety enclosure gate 11 for example as incorporated into pool fencing or playground fencing. The gate latch assembly 10 is a magnetic type latch assembly, the operation of which is similar to that described above with respect to WO '631. An exploded view of the gate latch assembly 10 is provided in FIG. 4.

The illustrated form of the gate latch assembly 10 comprises a first component 15 mounted to a fixed post 12 of the safety enclosure fencing and a second component 16 mounted to the gate 11. The first and second components 15, 16 releasably engage to hold the gate 11 in a closed position as shown in FIG. 1. The first component 15 provides the main latch structure of the latch assembly 10 (including the latch mechanism and keeper) and the second component 16 provides the striker of the latch assembly.

Although FIGS. 1-3 show an embodiment where the first component 15 is mounted to the fixed post 12 and the second component 16 is mounted to the gate 11, it is to be understood that the components 15, 16 could be mounted the other way around.

The first component 15 comprises a latch mechanism 17 incorporating a number of latch members coupled together to extend along a longitudinal axis, and a housing 21 containing at least a portion of the latch mechanism. One of the latch members is an elongate latching pin 20 housed within the housing 21. The housing 21 is mounted via mounting brackets 22 to the fixed post 12 and incorporates a keeper 18 disposed at a lower end of the housing 21 and which is arranged to receive the second (striker) component 16. A spring 23, which forms part of the latch mechanism 17, provides an upward bias on the latching pin 20 so as to hold the pin 20 in an upward position above the keeper 18 when the latching pin 20 is released from the striker 16 and the gate 11 is opened, as will be described in further detail below.

The second component 16 comprises a body 25 having a retaining element in the form of a recess 30 within which is located a permanent magnet 31. The body 25 is mounted to the gate 11 via a mounting portion 32 that couples to a mounting bracket 33. The second component 16, when the gate 11 is closed as shown in FIG. 1, is received within the keeper 18 of the first component 15. In this configuration, the permanent magnet 31 acts on the latching pin 20 disposed within the housing body 21 above the keeper 18, overcoming the bias of the spring 23 to draw the pin into the keeper 18 and then into recess 30 of the striker to capture the pin in the striker recess and thereby bring the latching pin into a latched condition.

To bring the latching pin 20 out of its latched condition (ie. into an unlatched condition) and enable the gate 11 to be opened, the latching mechanism 17 further comprises an actuator comprising a gripping portion for a user to grip in the form of a knob 35. The knob 35 is provided on the end of an arm 46, the opposed end of which is connected to the latching pin 20 via a link bar 38 of the latching mechanism 17. The arm 46 and the link bar 38 are further latch members of the latching mechanism and are configured, with the latching pin 20, to extend along the longitudinal axis. The knob 35 is located at and projects beyond the top of the housing 21. To open the gate 11, a user pulls the knob 35 upwards in the direction of the longitudinal axis, which raises the latching pin 20 out of the recess 30 and away from the magnet 31 which allows the gate to be opened. This usually requires a greater force (against that of the magnet) than can be applied by a small child, which in combination with the high location of the knob 35, enables the magnetic latch assembly to inhibit young children from releasing the latch without supervision.

With the gate 11 open, the biasing spring 23 holds the latching pin 20 in its now elevated position, even when the user lets go of the knob 35. Furthermore, the latch mechanism 17 comprises a lost motion arrangement incorporating a lost motion cage 36 which allows for the knob 35 to return to its rest position when the latching pin 20 is in its elevated position and also ensures that the weight of the upper portion 37 of the latch mechanism (which comprises the arm 46, knob 35 and link bar 38) does not bias the latching pin 20 into a lowered position which could otherwise prevent the latching pin 20 from adopting its latched condition when the gate is closed. Further details of the lost motion arrangement are disclosed in WO '631, the contents of which are incorporated by cross reference.

When the gate 11 is swung back to its closed position, the striker body 25 is brought back into alignment with the latching pin 20 and automatically draws the pin down back into the recessed member 30 under the influence of the magnetic force provided by the magnet 31. As described above, the magnetic force is sufficiently great enough to overcome the bias provided by the spring 23 that holds the latching pin up when the gate is open. As a result the latching of the gate happens automatically upon closing.

The gate latch assembly 10 also comprises a key-operated lock mechanism 40 for locking the latching pin 20 in its latched condition where it is retained in the recess 30. The lock mechanism 40 is also housed within the housing 21 of the first component. The lock mechanism 40 comprises a key barrel 41 having a key receiving opening 42 (see FIG. 1) in an outer face 43 (see FIG. 1) of the housing 21. Rotation of the key barrel 41 using the key brings the lock mechanism 40 into a locking condition where it engages with one of the latch members of the locking mechanism 17. More specifically, a first lock member 44 is rotated by rotation of the key barrel 41, which causes a second lock member 45 to move from a retracted configuration to a projected configuration where it engages the arm 46 extending from the knob 35. In this locking condition, the lock mechanism 40 prevents upward axial movement of the latch members including the latching pin 20 under manual operation of the knob 35 and thus locks the latching pin in its latched condition. In these conditions, the gate 11 cannot be unlatched and opened without the key to operate the lock mechanism 40, providing an additional level of safety. This can be most important in security applications such as gates for swimming pools, playground areas and other safety enclosures designed to inhibit the unauthorised entry of young children.

The embodiment of the gate latch assembly 10 illustrated in FIGS. 1 to 4 is an example of a basic assembly and is additionally capable of uses with the addition of at least one latch accessory. Alternative embodiments of the gate latch assembly with various attachable latch accessories and details of the coupling arrangements between the gate latch assembly and accessories will be discussed in more detail below.

Figure 9:
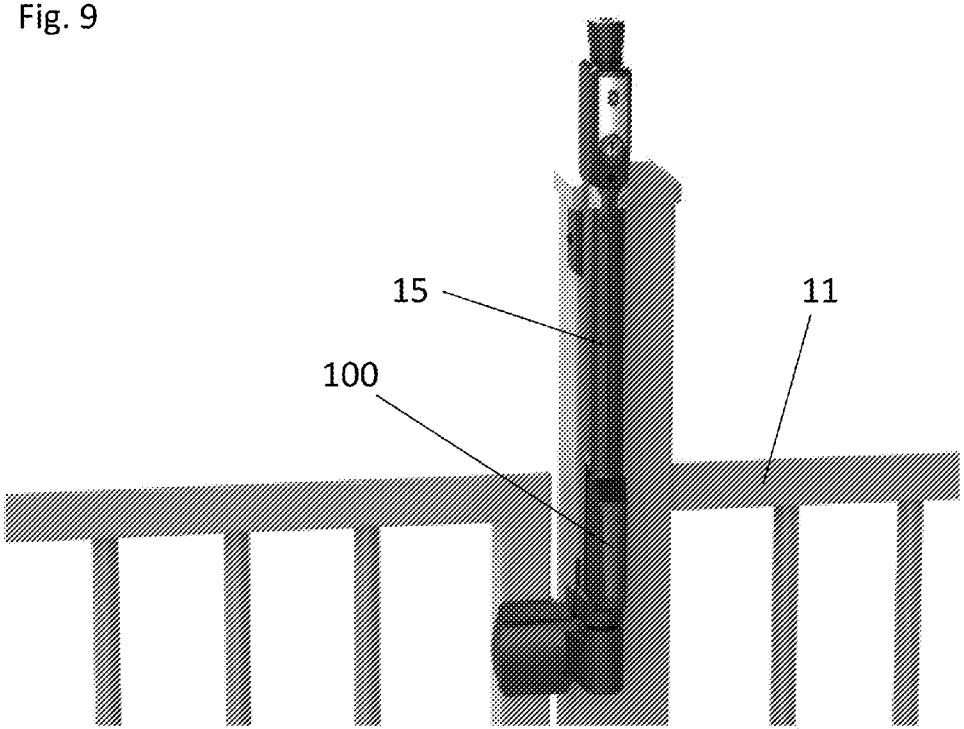
FIG. 9 is a perspective view of the gate latch assembly of FIG. 1 with an electronic alarm module fitted to the housing body.

The housing 21 is provided with one or more coupling portions enabling one or more latch accessories (see FIG. 9 for an example) to be mounted onto the housing 21 to modify the gate latch. In this way the gate latch assembly is of modular construction which enables various models (or customizable features) to be provided on the same base unit so as to modify the functionality of the gate latch. This has advantages both from a manufacturing perspective but also from a user perspective. In one form, a plurality of different latch accessories are provided to allow the gate latch assembly 10 to be modified by mounting a selected one or more of the latch accessories to the housing 21, the selected one or more of the latch accessories being selected from the plurality of different latch accessories.

Figure 5:
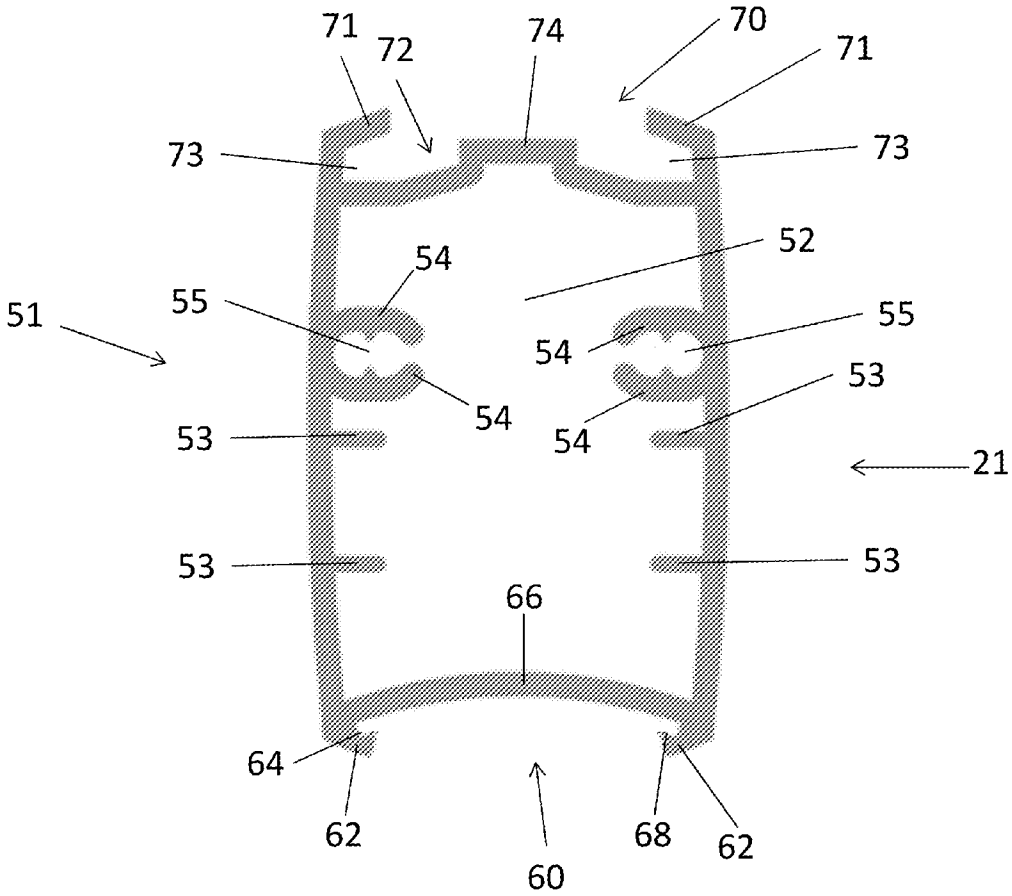
FIG. 5 is a cross-sectional view of a housing body of the gate latch assembly of FIG. 1.

The housing 21 of the first component 15 comprises a housing body 51 which extends along a longitudinal axis that is parallel to the longitudinal axis of the latch members and housing end structures 80, 85 at opposed ends of the body 51. FIG. 5 provides a cross-sectional view of the housing body 51 through its longitudinal axis.

The housing body 51 is an extruded section typically formed from a coated metal such as aluminium. The body 51 extends along a longitudinal axis that, when the gate assembly 10 is assembled, is parallel to the longitudinal axis of the latch members in the latching mechanism 17. This gives the housing body 51*a* generally elongate form to the first component 15 and allows the first component 15 to align with the fence post 12 on which is it mountable.

As shown in cross-section in FIG. 5, the housing body 51 comprises an internal cavity 52 arranged to receive components of the latch mechanism 17. Internal guides 53 are provided to maintain the alignment of the latch members of the latch mechanism (such as the link bar 38) within the cavity 52. Jaws 54 also project into the cavity 52 on opposed sides of the cavity to define respective slots 55 for receiving fixing screws to secure one or more end structures of the housing 21 (as detailed below) onto either end of the housing body 51. Because the housing body 51 is formed as an extrusion, the jaws 54 extend the length of the housing portion 51. However, it is to be understood that for the purposes of securing the end structures to the ends of the housing body 51, the jaws 54 may be formed only at each end of the housing body 51.

The housing body 51 further comprises front and rear coupling portions 60 and 70. The front coupling portion 60 is provided to enable one or more latch accessories 50 to be mounted to the housing 21 to modify the gate latch. The rear coupling portion 70 primarily provides a mounting section for coupling to the mounting brackets 22, so as to mount the first component 15 to the post 12 (or similar structure).

The front coupling portion 60 comprises two opposed rails 62 that extend axially along the length of the housing body 51. The rails 62 are located to opposed sides of the housing body 51. These rails project from an arcuate front wall 66 of the housing body 51 such that a recess 64 is formed between each rail 62 and the wall 66. A rearward facing shoulder 68 is provided on each rail which faces the front wall 66 to define a wall of the respective recess 64. Although, each rail 62 extends the length of the housing body 51, it is to be understood each rail 62 in other embodiments could extend only along part or parts of the housing body 51 and need not extend the full length. In one form, the front coupling portion comprises a plurality of rail segments spaced apart along the length of the housing body 51. In a further embodiment, the two rails could be replaced by a single rail, such as a T-shaped rail as the front coupling portion. In further embodiments, rather than rails, the front coupling portion could comprise one or more grooves or slots formed in the front wall or a plurality of studs and/or apertures on or in the front wall of the housing body. However, the rails 62 of the embodiment shown in the Figures advantageously allows the housing body 51 to be formed by extrusion and cut to any length as required for particular installation of the gate latch assembly 10.

The rear coupling portion 70 comprises a pair of rails 71 that extend from a rear wall 72 towards each other. These rear rails 71 are larger than the rails 62 of the front coupling portion 60 providing larger recesses 73 than the front recesses 64. The rear wall further defines a central ridge 74 that in use provides a guide that maintains alignment on the mounting bracket 22 in the rear coupling portion 70. The rear coupling portion 70 is not limited to solely mounting to the brackets 22 and may additionally or alternatively be used for mounting latch accessories to the first component 15 of the gate latch assembly 10. For instance, in non-illustrated alternative embodiments, a latch accessory in the form of a compliance tag is mounted to the first component 15 by coupling the tag to the rear coupling portion 70.

Figure 4:
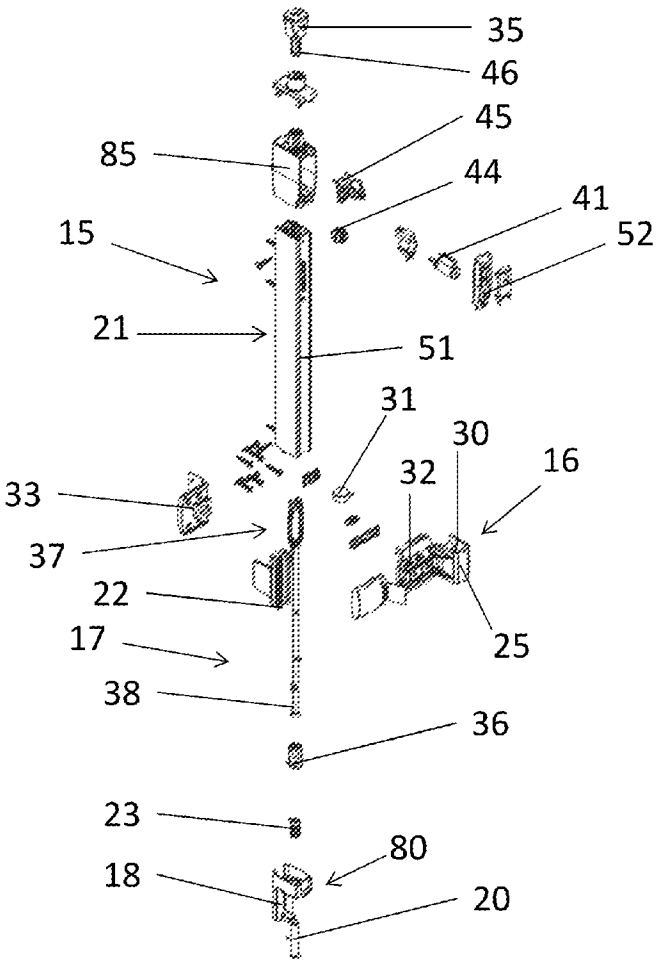
FIG. 4 is an exploded view of the gate latch assembly of FIG. 1.
Figure 6B:
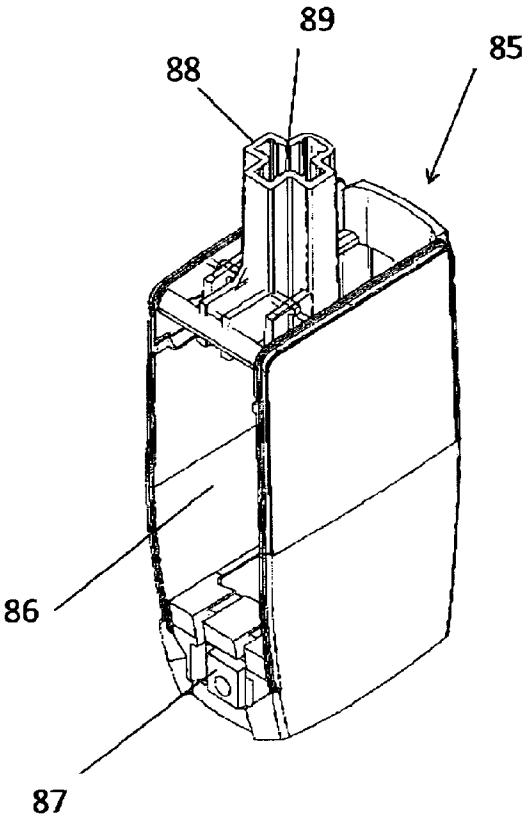
FIG. 6*a-b* show perspective views of (b) upper and (a) lower housing end structures of the gate latch assembly of FIG. 1.
Figure 6A:
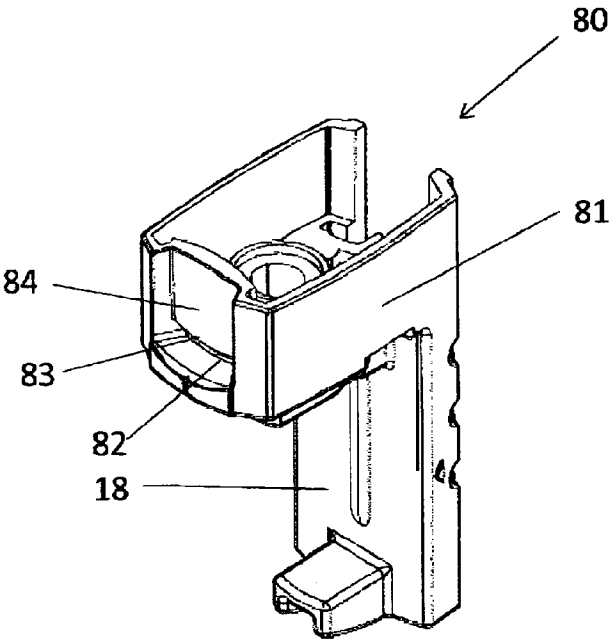

As shown in FIG. 4, the housing 21 comprises lower and upper end structures 80 and 85 which are mounted to opposed ends of the housing body 51. FIGS. 6*a* and 6*b* show these end structures in further detail. The lower end structure 80 comprises a body 81 which fits to the lower end of the elongate housing portion 51. The lower end structure also incorporates the keeper 18 depending from the body 81. The end structure 80 is fixed in position using fixing screws which locate within the slots 55 formed between the jaws 54 formed internally in the housing body 61. The front surface of the body 81 further comprises a coupling portion in the form of a recess 84 which forms an extension of the front coupling portion 60 provided on the housing body 51. A deeper portion 82 of the recess 84 defines a shoulder 83, which provides an anchoring region for one or more of the latching accessories when mounting each latching accessory to the housing 21, as will be described in further detail below.

The upper end structure 85 of the housing 21 contains the lock mechanism 40 of the latch and seats the knob 35 on top of the upper end structure 85 over a projection 88 extending upwardly from the top of the upper end structure 85. The arm 46 extending from the knob 35 extends through an aperture 89 in the projection 88 and into a cavity 86 in the upper end structure 85 where it is coupled to the link bar 38 of the latch mechanism 17. The upper end structure 85 also comprises a securing collar 87 which fits over an upper end of the front coupling portion 60 of the housing body 21. The collar 87 is spaced from the housing body 51. This space defines an anchoring region for one or more of the latching accessories when mounting each latching accessory to the housing 21, as will be described in further detail below.

The latch accessory may be a decorative feature, such as a replaceable cover or decorative banner that allows the aesthetic of the gate latch assembly to be modified, or may interact with the latch mechanism to modify the function of the gate latch, such as an electronic sensor or alternative access latch accessory. The electronic sensor alerts the user when the gate latch is in an unlatched condition for a predetermined period of time. The alternative latch accessory enables the operation of the latching mechanism to bring the latching pin 20 out of its latched condition to be actuated by an alternative actuator to the primary actuator (i.e. knob 35).

Various latch accessories which can be mounted to the coupling positions of the housing 21, as described above, are shown in FIGS. 7 to 15.

Figure 7:
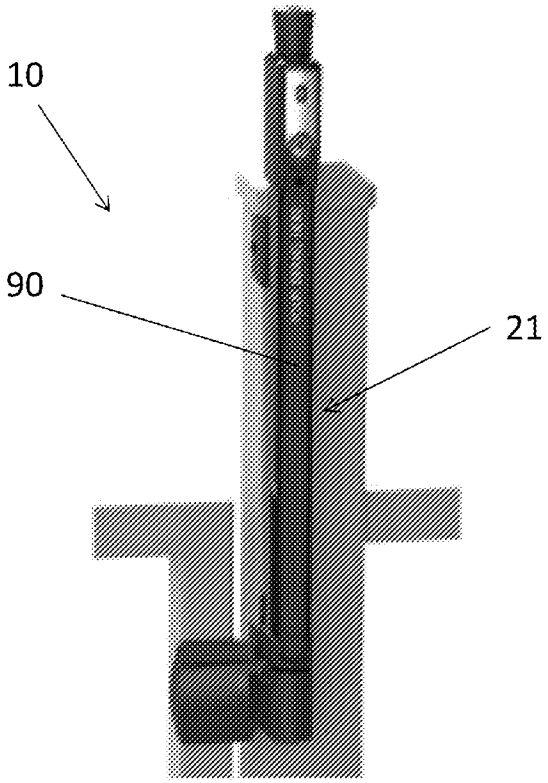
FIG. 7 is a perspective view of the gate latch assembly of FIG. 1 with a cover strip fitted to the housing body.
Figure 8:
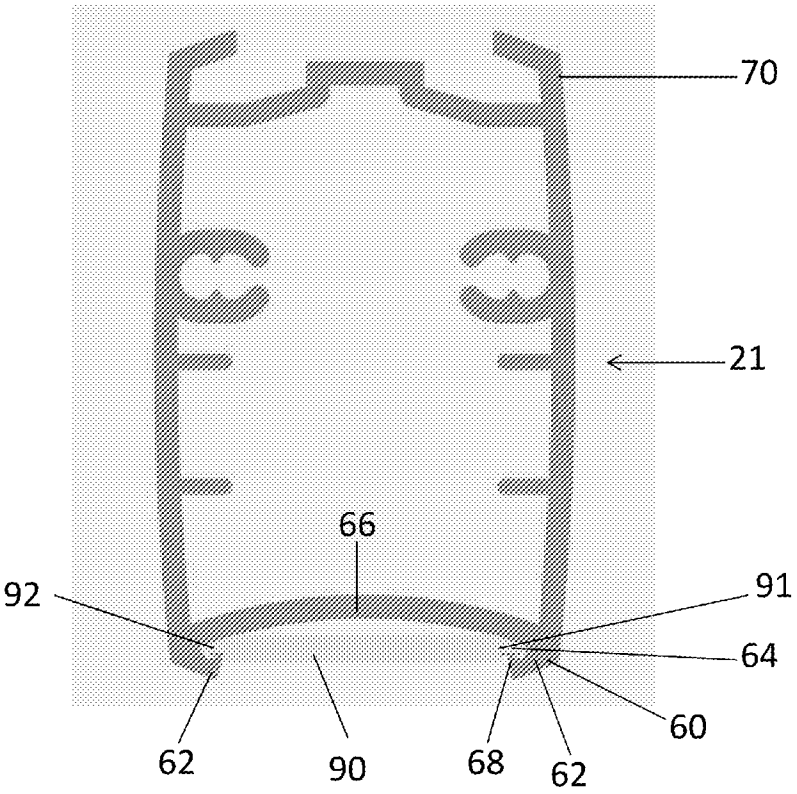
FIG. 8 is a cross-sectional view of the elongate housing body of FIG. 7 with the cover strip fitted thereto.

FIGS. 7 and 8 illustrate a latch accessory in the form of a cover strip 90, mounted to the housing 21 by coupling the strip 90 to the front coupling portion 60 of the housing body 51.

The cover strip (which may be solely decorative or may contain product information or warnings) is held along its side edges 91, 92 by the rails 62. The cover strip 90 may be coupled to the front coupling portion 60 by sliding from one end of the housing body 51 prior to mounting one of the upper or lower housing end structures 80, 85 on to the housing body 51. Alternatively, the cover strip 90 may be retrofitted in place 92 after assembly of the latch 15 by being resiliently deformed so that the edges 91 of the cover strip 90 can locate behind the rails 62. The cover strip 90 can then be allowed to return to its natural state where the edges 90 extend into the recess 64 thereby ensuring the strip 90 is held in place. In a further embodiment, the cover strip may be provided with resiliently deformable hook portions which "snap-fit' to the rails in order to couple the cover strip to the rails.

Another type of latch accessory, an electronic alarm module 100 is shown in FIGS. 9 to 12.

The electronic alarm module 100 can be mounted to the first component 15 of the gate latch assembly 10 by coupling to the front coupling portion 60 on the housing body 51. The purpose of the electronic alarm module 100 is to sound a warning alarm if the gate is not properly latched. The alarm module 100 may be retro-fitted to the gate latch without any disassembly of the gate latch assembly 10.

The electronic alarm module 100 operates by sensing the magnetic field of the latching pin 20. The operation of the electronic sensor is described in the Applicant's co-pending application entitled "Sensor Configuration for a Latching Assembly", the contents of which are herein incorporated by cross-reference.

Figure 10B:
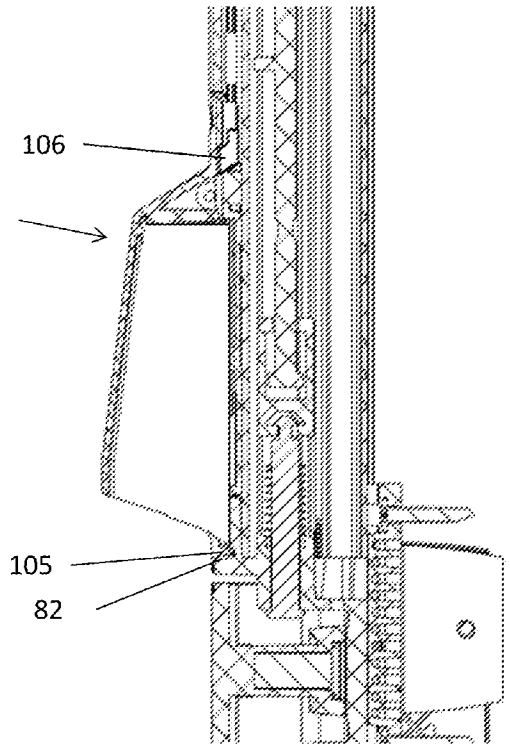
FIGS. 10*a-b* are (a) perspective and (b) cross-sectional views of the gate latch assembly of FIG. 9 with the electronic alarm module fitted.
Figure 10A:
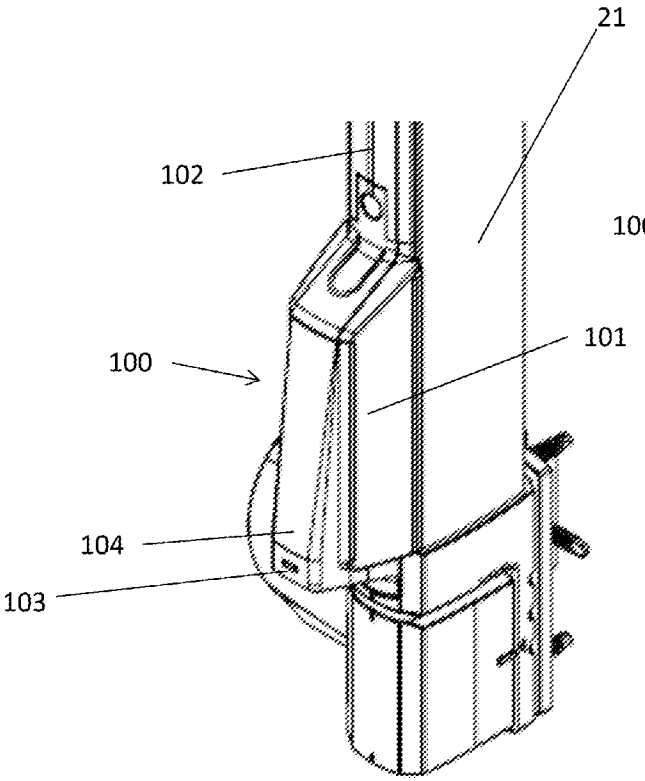
Figure 11:
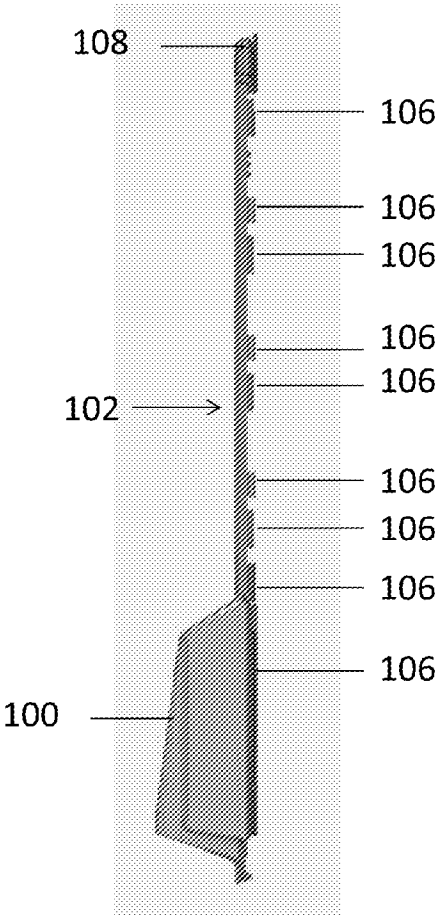
FIG. 11 is a side view of the electronic alarm module of FIG. 9 in isolation.

The electronic alarm module 100 is shown in FIGS. 10*a-b* fitted to the housing 21. The module comprises a body 101 which houses the electrical components of the module, a facing strip 102 which extends from the body and a light indicator 103 located at a distal end 104 of the body 101 from the strip 102. The module 100 comprises a lower retaining tab 105 which projects from the distal end of the body 101 from the strip 102, an upper retraining tab 108 at the distal end of the strip 102 from the body 101, and a plurality of protrusions 106 distributed along the length of strip. In the illustrated form, the protrusions 106 are in the form of resiliently deformable hook portions.

Figure 12:
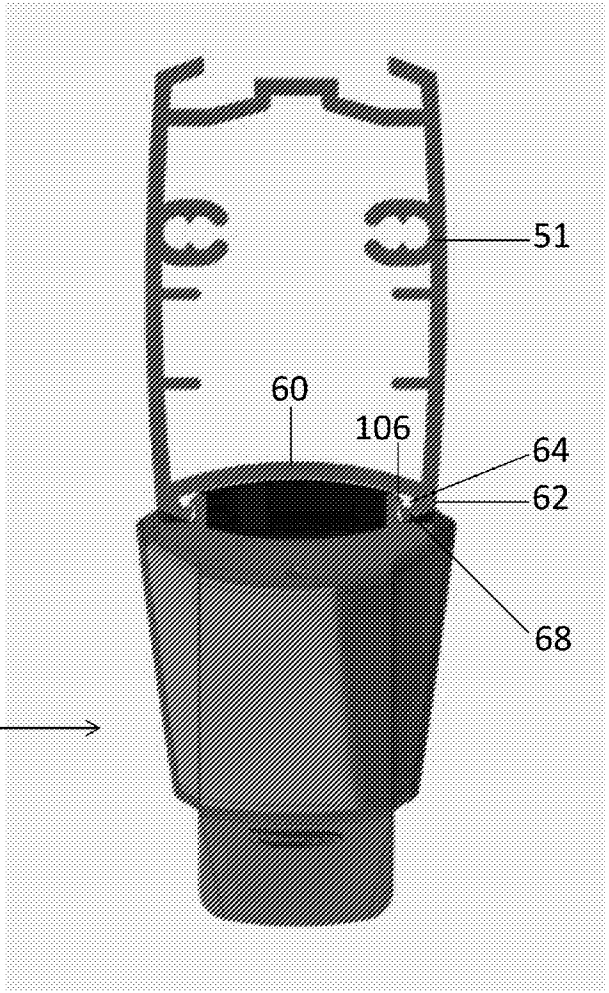
FIG. 12 is a view in cross-section through the housing body of FIG. 9 of the housing body with the electronic alarm module fitted to the housing body.

The retaining tabs 105, 108 and the protrusions 106 form coupling portions to couple to coupling portions of the housing 21. Specifically, the retaining tab 105 is arranged to be received in the lower anchoring region provided by the shoulder 83 defined by the deeper recess portion 82 in the lower housing end structure 80. The protrusions 106 (see FIG. 11) couple by snap-fitting to the rails 62 of the housing body 51 (as best shown in FIG. 12). The upper tab 108 fits in the upper anchoring region between the securing collar 87 of the upper end structure 85 of the housing 21 and the housing body 51. The protrusions 106 are pushed into the recesses 64 by a user and the module 100 is held in mounting engagement behind the shoulder 68 against the front wall 66 of the housing body 51. By coupling to the upper and lower anchoring regions, the electronic alarm module 100 is firmly and securely fixed vertically, relative to the housing 21 of the gate latch assembly 10.

When a user is mounting the electronic alarm module 100 to the housing 21, the following steps may be performed:

a) the upper tab 108 is positioned in the upper anchoring region by sliding the tab 108 under the securing collar 87 between the collar 87 and the front wall 66 of the housing body 51;

b) the module 100 is rotated and the protrusions 106 are forced into engagement with the rails 62 of the housing body 51 by the resilient deformation and release of a snap fit coupling;

a) the tab 105 is located in the anchoring region defined under shoulder 83 formed by the recess 82 in the lower end structure 80;

Removal of the electronic alarm module 100 is achieved by reversing the steps performed for mounting;

In non-illustrated alternative embodiments, the coupling portion of the electronic alarm module may be in the form of ribs which are configured to slide into the recesses 64 formed by the rails 62 of the housing body 51 (i.e. similar to the cover ship 90). In other embodiments the electronic alarm module may couple to the housing 21 by an interference fit, or may utilise mechanical fasteners.

Referring to FIGS. 13-15, the gate latch assembly is shown incorporating, as a latching accessory an alternative actuator module 200 mounted to the housing 21 of the housing body 51. The purpose of the alternative actuator module 200 is to enable a person to operate the latching mechanism if they are unable to reach the primary actuator i.e. knob 35. The alternative actuator module 200 is particularly suitable for providing disabled access through the gate of the safety enclosure on which the gate latch assembly is installed. For example for a wheel-chair bound person it may not be possible for them to reach the top of the housing, and an actuator is required at a lower position for them to operate.

The alternative actuator module 200 comprises a base component 201 that is mounted to the housing 21 of the gate latch assembly 10 such that it interacts with the latching mechanism 17 to enable operation of the latching mechanism via the alternative actuator module 200. The module 200 also comprises an actuator 204 that couples to the base component 201. The actuator 204 has a gripping portion, which in FIGS. 13-15 is in the form of a handle, by which a user can operate the latching mechanism 17 to bring the latching pin 20 out of its latched condition. The actuator 204 of the alternative actuator module 200 provides an alternative actuator for operating the latching mechanism 17 to the knob 35 at the top of the housing 21. The knob 35 remains the primary actuator which is operable when the alternative actuator module 200 is installed in the gate latch assembly 10.

Figure 15B:
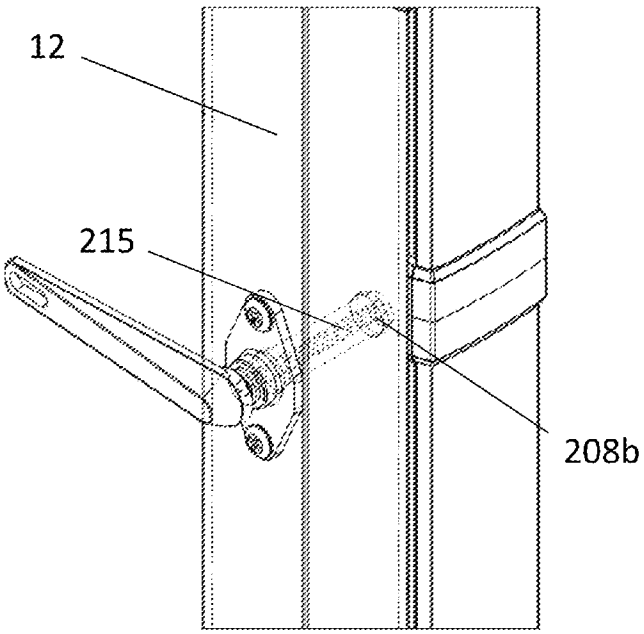
FIG. 15*a-b* are a perspective views of the gate latch assembly of FIGS. 13*a-b* illustrating the assembly of a handle of the alternative actuator module at the front (FIG. 15*a*) and the rear of the gate (FIG. 15*b*)
Figure 15A:
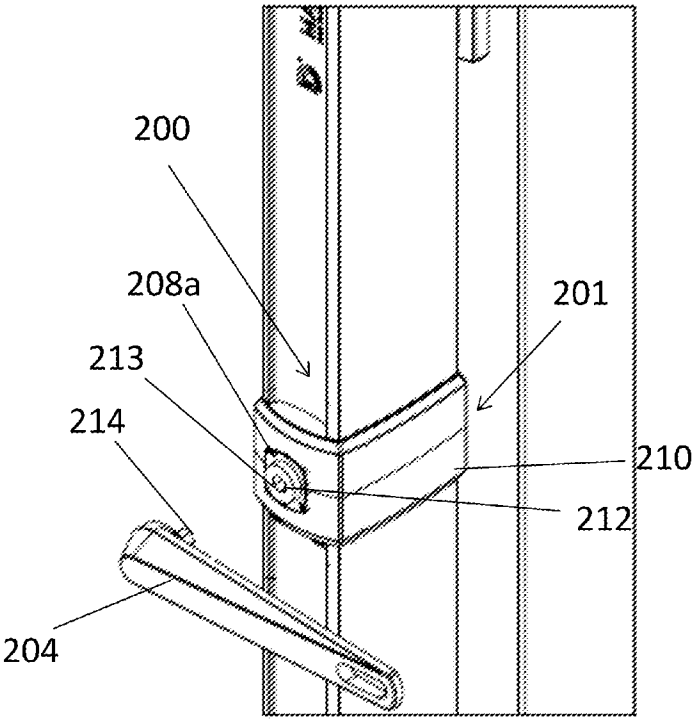

As shown in FIG. 15*a*, the actuator 204 of the alternative actuator module 200 is readily attachable and detachable from the base component 201. This enables the actuator 204 to be removed from the gate latch assembly 10 to render the alternative actuator module 200 inoperative whilst leaving the base component 201 mounted thereon. The actuator 204 can then be quickly and easily reattached to the base component 201 in order to operate the latching mechanism 17 via the alternative actuator module 200. This is advantageous where the alternative actuator module 200 is located in a lower region of the gate latch assembly 200 to enable a wheelchair bound adult to open the gate. In such applications, the lower location of the alternative actuator module 200 may be accessible by children. However, by enabling the actuator 204 to be readily detached, undesirable opening of the gate by children via the alternative actuator module 200 can be mitigated.

To incorporate the alternative actuator module 200 into the gate latch assembly 10, modification of some of the assembly components is required. This modification includes providing an aperture 208*a, b* through each of the front and rear walls 66, 72 of the housing body 51. The apertures 208*a, b* are aligned to define a passage through the housing body 51 transverse to its longitudinal axis. The apertures 208*a, b* on either side of the housing body 51 enable the alternative actuator module 200 to be operable from either side of the gate. It is to be appreciated, however, that in embodiments where it is desired for the alternative actuator module is to be operable from only one side of the gate, only a single aperture is formed through one of the walls of the housing body.

A further modification of the gate assembly to incorporate the alternative actuator module 200 is that one or more engagement portions each in the form of a projection 202 is provided on the link bar 38 or one of the other latch members in the latch mechanism 17. Two projections are provided in the embodiment shown in the Figures to enable operation of the alternative actuator module on a right hand opening or left hand opening gate. However, in other embodiments, only a single projection may be provided, which in at least some of those embodiments limit the use of the alternative actuator module on only a right hand or left hand opening gate.

The base component 201 of the alternative actuator module 200 comprises a module cover 210 that is fitted to the external surface of the housing body 51. The module cover 210 closes over the apertures 208*a, b* in the housing body 21 to mitigate the ingress of moisture and particles. The base component 201 also comprises an actable member 205 that is located, at least in part, in the housing body 51. The actable member 205 comprises a rotatable body 211 with engagement portions in the form of lever arms 206*a, b* extending from the body 211 for engaging the projection 202 on the link bar 38 in the latch mechanism 17. The rotatable body 211 extends transversely to the longitudinal axis of the housing body 21 and the latch members of the latching mechanism 17 between the apertures 208*a, b* formed in the housing body 51.

The body 211 extends out of the apertures 208*a, b* and the module cover 210 on either side of the housing 21. The body 211 is generally cylindrical and has respective end surfaces 212 that face outwardly. Each end surface 212 is provided with a keying formation 213 shown in the form of a hexagonal recess (although any suitably shaped recess, projection or other formation may be provided). The keying formations 213 provide locations for a correspondingly shaped keying formation 214 on the actuator 204 (in the illustrated embodiment, a hexagonal projection) to engage the body 211 of the actable member 205 to thereby operate the latching mechanism 17.

As shown in FIG. 15*b*, where the housing 21 is mounted on one side of a post 12, to operate the alternative actuator module 200 from the other side of the post 12, an extension member 215, coupled to the body 211 of the actable member 205, extends through the post 12. The extension member 215 is provided with a keying formation 216 to enable engagement thereto of the keying formation 214 of the actuator 204.

The lever arms 206*a, b* of the actable member 205 are located on either side of the body 211 to enable the alternative actuator module 200 to be used on a right hand opening or left hand opening gate. In other embodiments, the actable member may be provided with only a single lever arm or other engagement portion although such embodiments could only be used on either a right hand opening or left hand opening gate.

Each lever arm 206*a, b* is bent so as to maintain engagement with the projection 202 on the link bar 38 and smooth movement of the latching mechanism 17 as the alternative actuator module 200 is operated, as will be described below.

With the actuator 204 engaged to the body 211 of the actable member 205, use of the alternative actuator module 200 to operate the latching mechanism 17 to unlatch the latching pin 20 involves rotating the actable member 205 using the actuator 204. By the engagement of one of the lever arms 206*a, b* on the projection 202 on the link bar 34, the link bar 34 and the latching pin 20 coupled thereto are moved axially in a vertically upward direction. This lifts the latching pin 20 out of the recess 30 of the second striker component 15 to unlatch the gate latch and enable opening of the gate.

Although, the embodiments of the gate latch assembly disclosed herein are shown with respect to the magnetic latching arrangement, it is to be understood that various embodiments of latch accessories can be used with any type of latching arrangement.

Some advantages of embodiments of the gate latch assembly according to the present disclosure are as follows.

a) The assembly 10 is versatile in application. Various modular components with different add-on features can be mounted to the housing 21 of the first component 15. This enables maximum opportunity for modification, adaptability and applicability of the assembly 10 across a broad range of uses.

b) Manufacturers benefit from the versatility through the implementation of a more streamlined production. For example, the housing body 51 may be formed as an extrusion which can be produced at any length required. Inventory costs would also be reduced because the base model is common.

c) Individual users benefit from the versatility through personalisation of the modular component being highly adaptable.

d) The latch accessories may provide technical upgrades or improvements and as a result, an opportunity to upgrade without re-purchasing a new base latch assembly.

e) The gate latch assembly is robust. The housing may be made from extruded sections of aluminium and the latch accessory may be made from moulded plastic. These are highly durable materials designed to withstand inclement weather and frequent use.

It is to be understood that, if any prior art publication is referred to herein, such reference does not constitute an admission that the publication forms a part of the common general knowledge in the art, in Australia or any other country.

In the claims which follow and in the preceding disclosure, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the present disclosure.

Accordingly, the present disclosure is not to be limited in terms of the particular embodiments described in this application, which are intended as illustrations of various aspects.

Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods which can, of course, vary. It is also to be understood that the terminology used herein is for the purpose of describing particular embodiments only, and is not intended to be limiting.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the claims.

ALTERNATIVE STATEMENTS OF INVENTION

Alternative statements of invention are recited in the following numbered clauses.

1. A magnetic gate latch arranged to be mounted to either a gate or gate post and adapted to co-operate with a component mounted on the other of the gate or gate post to hold the gate closed, the gate latch comprising:
   a latch mechanism, and
   a housing containing at least a portion of the latch mechanism, the housing being configured to receive at least one latch accessory to interact with the latch mechanism to affect a functional aspect of the gate latch.
2. A gate latch according to clause 1, wherein the housing is configured so the at least one latch accessory adds an additional feature and/or function to the gate latch.
3. A gate latch according to clause 1 or 2, wherein the housing is configured so the at least one latch accessory is mountable to a front wall or an outer facing wall of the housing.
4. A gate latch according to any one of the preceding clauses, wherein the housing comprises at least one coupling portion configured to receive the at least one latch accessory having a complementary coupling portion so as to mount the at least one latch accessory to the housing.
5. A gate latch according to clause 4, wherein the at least one coupling portion of the housing is configured to enable engagement of the at least one latch accessory coupling portion with the housing coupling portion in a snap fit arrangement.
6. A gate latch according to clause 4, wherein the at least one coupling portion of the housing is configured to enable engagement of the least one latch accessory coupling portion with the housing coupling portion in a sliding arrangement.
7. A gate latch according to any one of clauses 4 to 6, wherein the at least one coupling portion of the housing is integrally formed with the housing.
8. A gate latch according to any one of clauses 4 to 7, wherein the at least one coupling component of the housing comprises one or more rails provided on the housing.
9. A magnetic gate latch arranged to be mounted to either a gate or gate post and adapted to co-operate with a component mounted on the other of the gate or gate post to hold the gate closed, the gate latch comprising:
   a latch mechanism, and
   a housing containing at least a portion of the latch mechanism, the housing being configured to receive at least one latch accessory,
   wherein the housing comprises a rear face, and at least one outer face, the at least one outer face comprising one or more rails configured to receive the at least one latch accessory having a complementary coupling portion so as to mount the at least one latch accessory to the housing.
10. A gate latch according to clause 8 or 9, wherein each rail extends the substantial length of the housing.
11. A gate latch according to any one of clauses 8 to 10, wherein each rail comprises a plurality of rail segments.
12. A gate latch according to any one of clauses 4 to 11, wherein the housing comprises a body extending between a first end and a second end along a longitudinal axis and at least one of the coupling portions of the housing extends longitudinally along the body.
13. A gate latch according to clause 12, wherein the housing body is in the form of an extruded section.
14. A gate latch according to clause 12 or 13, wherein the housing comprises at least one housing end structure mounted to one or each end of the body.
15. A gate latch according to clause 14, wherein one or each of the housing end structures has formed thereon at least one of the coupling portions of the housing.
16. A gate latch according to any one of clauses 1 to 15, the latch mechanism having an internally mounted latch member, the latch member being moveable between an engaging position and a retracted position, wherein when the latch member is in the retracted position it retracts into the housing.
17. A gate latch according to clause 16, wherein the latch further comprises an actuator for moving the latch member from the retracted to the engaging position within the housing.
18. A gate latch according to any one of clauses 1 to 17, wherein the housing is configured so the at least one latch accessory is removably securable to the housing.
19. A gate latch according to any one of clauses 1 to 18, wherein the at least one latch accessory is removably secured to the housing that operates independently to the latch mechanism, such that the at least one latch accessory can be removed from the housing without disassembly of the latch mechanism.
20. A gate latch according to any one of clauses 1 to 18, wherein the at least one latch accessory comprises at least an electronic alarm unit removably secured to the housing that operates independently to the latch mechanism, such that the electronic alarm unit can be removed from the housing without disassembly of the latch mechanism.
21. A gate latch assembly comprising the gate latch according to any one of clauses 1 to 20 and at least one latch accessory receivable on the gate latch.

22. A gate latch assembly according to clause 21, wherein the at least one latch accessory adds an additional feature and/or function to the gate latch.
23. A gate latch assembly according to clause 21 or 22, wherein the at least one latch accessory is mounted on a front wall or outer facing wall of the housing.
24. A gate latch assembly according to any one of clauses 21 to 23, wherein one of the at least one latch accessories further comprises a decorative latch accessory that is configured to modify the appearance of the gate latch when received thereon.
25. A gate latch assembly according to clause 24, wherein the decorative latch accessory comprises a replaceable cover or decorative banner.
26. A gate latch assembly according to clause any one of clauses 21 to 25, wherein one of the at least one latch accessories comprises an electronic sensor that is configured to alert a user when the latch mechanism is in an unlatched condition when the electronic sensor is received on the gate latch.
27. A gate latch assembly according to clause any one of clauses 21 to 26, wherein the latch mechanism comprises a primary actuator which is operative to unlatch the latch mechanism from a latched condition, and one of the at least one latch accessories comprises an alternative actuator module that provides a second actuator at a different location to the primary actuator which is also operative to unlatch the latch mechanism from its latched condition.
28. A gate latch assembly according to clause 27, wherein the alternative actuator module comprises a base component that is configured to interact with the latching mechanism and wherein the second actuator is coupled to the base component.
29. A gate latch assembly according to clause 28, wherein the actuator is detachable from the base component to render the alternative actuator module inoperative.
30. A gate latch assembly according to clause 28 or 29, wherein the second actuator and the base component comprise corresponding key formations to enable coupling of the actuator to the base component.
31. A gate latch assembly according to any one of clauses 28 to 30, wherein the base component comprises an actable member that is located within the housing of the gate latch in engagement with the latch mechanism.
32. A gate latch assembly according to any one of clauses 28 to 31, wherein the second actuator is located below the primary actuator.
33. A gate latch assembly according to any one of clauses 21 to 32, the latch assembly further comprising a striker that cooperates with the latch mechanism of the gate latch to effect latching.
34. A latch assembly according to clause 33 when dependent on clause 16, wherein the striker includes a retaining element that is configured to receive a portion of the latch mechanism in the engaging position.
35. A magnetic gate latch assembly comprising:
the gate latch according to any one of clauses 1 to 19; and
a plurality of different latch accessories interact with the gate latch to affect a functional aspect of the gate latch by receiving a selected one or more of the latch accessories on the housing.
36. A gate latch assembly according to clause 35, wherein the at least one of the plurality of different latch accessories provides one additional feature and/or function for the gate latch.
37. A method of assembling a magnetic gate latch assembly, the method comprising providing a gate latch comprising a latch mechanism and a housing configured to receive a latch accessory that interacts with the latch mechanism to affect a functional aspect of the gate latch; and mounting a latch accessory to the housing.
38. A method of assembling a magnetic gate latch assembly, the method comprising:
(a) providing a gate latch comprising a latch mechanism;
(b) mounting at least one latch accessory to the gate latch to form the gate latch assembly, whereby when mounted the latch accessory interacts with the latch mechanism.
39. A method of assembling a magnetic gate latch assembly according to clause 37 or 38, wherein the at least one latch accessory is removably secured to the housing that operates independently to the latch mechanism, such that the at least one latch accessory can be removed from the housing without disassembly of the latch mechanism.
40. A method of assembling a magnetic gate latch assembly according to clause 37 or 38, wherein the at least one latch accessory comprises at least an electronic alarm unit removably secured to the housing that operates independently to the latch mechanism, such that the electronic alarm unit can be removed from the housing without disassembly of the latch mechanism.
41. A kit comprising:
a magnetic gate latch in accordance with any one of clauses 1 to 20; and
at least one latch accessory configured to be installed on the housing of the gate latch, the at least one accessory being able to be installed on the housing without disassembly of the gate latch.
42. A kit according to clause 41, wherein the at least one latch accessory is an electronic alarm unit.

What is claimed is:

1. A magnetic gate latch assembly arranged to be mounted to either a gate or gate post and adapted to co-operate with a striker having a magnet mounted on the other of the gate or gate post to hold the gate closed, the gate latch assembly comprising:
a housing having a keeper arranged to receive the striker;
a latch mechanism disposed within the housing and having an internally mounted latching pin, the latching pin being movable between a latched condition where the latching pin is drawn into the striker by magnetic force provided by the magnet of the striker and an unlatched condition where the latching pin retracts into the housing;
an actuator for releasing said latching pin from the latched condition; and
at least one latch accessory in the form of a modular component removably engageable with at least one coupling portion of the housing to mount the modular component to the housing, the modular component houses an electronic sensor operable to sense a magnetic field of the latching pin through the housing to indicate a condition of the gate latch assembly via indirect sensing, the modular component being able to be removed from the housing during the normal operation of the latch mechanism.

2. A gate latch assembly as claimed in claim 1, wherein the at least one latch accessory comprises a complementary coupling portion.

3. A gate latch assembly as claimed in claim 2, wherein the at least one coupling portion is arranged to resiliently engage the at least one latch accessory in a snap fit arrangement.

4. A gate latch assembly as claimed in claim 3, wherein the housing includes an elongate body extending between a first end and a second end.

5. A gate latch assembly as claimed in claim 4, wherein the at least one coupling portion extends longitudinally along the elongate body.

6. A gate latch assembly as claimed in claim 5, wherein the at least one coupling portion comprises one or more rails that extend along the elongate body.

7. A gate latch assembly as claimed in claim 6, wherein the housing is in the form of an extruded section.

8. A gate latch assembly as claimed in claim 7, wherein the housing further comprises a mounting structure mounted to the elongate body.

9. A gate latch assembly as claimed in claim 8, wherein the mounting structure includes one of the at least one coupling portion.

10. A gate latch assembly as claimed in claim 9, wherein a portion of the mounting structure is secured to an end of the elongate body.

11. A gate latch assembly as claimed in claim 10, wherein the at least one coupling portion is able to receive the at least one latch accessory that is formed partly on the body and partly on the mounting structure.

12. A gate latch assembly according to claim 1, wherein the sensed magnetic field of the latching pin is used to issue an alert when the striker is engaged with the keeper and the latch pin is not in a latched condition.

13. A method of assembling and operating the magnetic gate latch assembly according to claim 1, the method comprising:

(a) providing the gate latch assembly including the housing containing at least a portion of the latch mechanism;

(b) mounting the at least one latch accessory to the housing, (c) using the electronic sensor to sense a magnetic field of the latching pin of the latch mechanism through the housing, and if required (d) removing the modular component from the housing whereby removal of the modular component is achieved during the normal operation of the latch mechanism.

14. The method according to claim 13 further comprising sliding the modular component into sliding engagement with the housing.

15. The method according to claim 14 further comprising applying force to the modular component to resiliently engage the modular component with the housing.

16. The method according to claim 15 further comprising using the sensed magnetic field of the latching pin to issue an alert when the striker is engaged with the keeper and the latch pin is not in a latched condition.

* * * * *